US005625443A

United States Patent [19]

Ohta et al.

[11] Patent Number: 5,625,443

[45] Date of Patent: Apr. 29, 1997

[54] CLEANING DEVICE FOR THE XEROGRAPHY MACHINE

[75] Inventors: Kouji Ohta; Yoshiaki Abe; Minoru Niwa, all of Kanagawa, Japan

[73] Assignee: Fuji Xerox Co., Ltd., Tokyo, Japan

[21] Appl. No.: 360,446

[22] Filed: Dec. 21, 1994

[30] Foreign Application Priority Data

Dec. 24, 1993 [JP] Japan ..... 5-328571
Oct. 14, 1994 [JP] Japan ..... 6-249740

[51] Int. Cl.[6] ..... G03G 21/00

[52] U.S. Cl. ..... 399/353

[58] Field of Search ..... 355/296, 297, 355/298, 301, 302; 15/256.5

[56] References Cited

U.S. PATENT DOCUMENTS

| | | | |
|---|---|---|---|
| 4,427,289 | 1/1984 | Oda | 355/301 X |
| 4,435,073 | 3/1984 | Miller | 355/298 X |
| 4,819,026 | 4/1989 | Lange et al. | 355/298 |
| 4,835,807 | 6/1989 | Swift | 15/256.5 X |
| 5,012,283 | 4/1991 | Shimono et al. | 355/229 |

FOREIGN PATENT DOCUMENTS

| | | |
|---|---|---|
| 58-98769 | 6/1983 | Japan . |
| 63-146874 | 9/1988 | Japan . |
| 1-75276 | 5/1989 | Japan . |
| 1-120179 | 8/1989 | Japan . |
| 2-29221 | 6/1990 | Japan . |
| 3-153287 | 7/1991 | Japan . |

*Primary Examiner*—Sandra L. Brase
*Attorney, Agent, or Firm*—Finnegan, Henderson, Farabow, Garrett & Dunner, L.L.P.

[57] ABSTRACT

A cleaning device for removing and collecting toner left on the surface of a photoreceptor includes a housing, a rotary shaft rotatably supported by the housing and a brush, provided on the outer surface of the rotary shaft, for scraping off toner from the surface of the photoreceptor, a bar-like member fastened at both ends thereof to the housing and positioned at a location where the bar-like member is flicked with upon the rotation of the brush, an auger, positioned at a predetermined location within the housing, for transporting the toner scraped off to a given direction, and the bar-like member being disposed so as to prevent the auger from being further moved from the predetermined position and from contacting with the brush. Further, an image forming apparatus includes an earth plate fastened to the side wall of the housing is provided with first and second plate-like terminals, the first terminal is in contact with the end of a shaft of the cleaning brush, and the second terminal is in contact with the end of the flicker bar.

13 Claims, 6 Drawing Sheets

CLEANING DEVICE FOR THE XEROGRAPHY MACHINE

BACKGROUND OF THE INVENTION

The present invention relates to a cleaning device for the Xerography machine, which includes a brush in contact with a photoreceptor and an auger for transporting toner scraped off with the brush in the axial direction.

This type of the cleaning device is disclosed in Published Unexamined Japanese Utility Model Application No. Hei. 1-75276. In this cleaning device, the brush is always in contact with the auger.

There is another conventional cleaning device in which a flicker bar is in contact with the brush. This cleaning device is constructed as shown in FIG. 1. A flicker bar b, shaped like a frame in cross section, is formed of a plastic mold. It includes a part brought into contact with a brush a. The flicker bar b is fastened to a cleaning housing c by means of screw means. When an auger d is deformed upward, it comes in contact with the frame part of the flicker bar b. With this contact, the auger d is prevented from being excessively deformed toward the brush a.

Another technique is disclosed in Published Unexamined Japanese Patent Application No. Hei. 3-153287. In this technique, a bias voltage is applied to the shaft of a conductive brush. Therefore, a bias voltage applying means is indispensably required. In this respect, the disclosed technique is disadvantageous in space and cost.

An additional technique is disclosed in Published Unexamined Japanese Utility Model Application No. Sho. 63-146874. In this technique, toner is removed through the contact with the cleaning brush. Accordingly, an additional space is required for the roller and the flicker. This technique is also disadvantageous in space and cost.

The advantageous fact that when the cleaning brush per se is charged properly (viz., at a proper polarity and at a proper quantity of charge), the cleaning performance is improved, and paper particles, discharge by-products, talc, etc. are effectively removed, is confirmed. The disadvantageous fact that an excessive discharge brings about picture quality degradation, and generation of radio wave noise, is also known.

In the first conventional cleaning device disclosed in Published Unexamined Japanese Utility Model Application No. Hei. 1-75276, the auger is constantly pressed against the outer circumference of the brush. Because of this, the auger is deformed toward the opposite side of the brush. The thus deformed auger forcibly rubs the cleaning housing, so that noisy sound is generated and the inner surface of the housing is scraped off. When the collector bottle is full of toner and a heavy load is applied to the auger, the auger possibly damages the brush.

In the second conventional cleaning device of the type in which a flicker bar is in contact with the brush, a great variation of the quantity of the nip of the brush a and the flicker bar b makes it difficult to gain a proper flicking effect. With a structure that the flicker bar b is fastened to the upper wall of the cleaning housing c by screw means, the flicker bar b does not constitute one of the strengthening members of the cleaning housing c. In other words, it cannot reinforce the cleaning housing c in any way.

The number of the parts required for earthing the brush and the flicker bar is reduced as small as possible.

To remove electrical noise generated from the brush and the flicker bar, these must be earthed. Earthing of the brush is difficult since the rotating shaft of the brush must be earthed.

SUMMARY OF THE INVENTION

The present invention has been made in view of the above circumstances and has an object to provide a cleaning device which prevents the auger from being deformed by the brush.

Another object of the present invention is to provide a cleaning device which solves such a problem that when an excessive load acts on the auger, the auger is deformed toward the brush to thereby damage the brush.

Still another object of the present invention is to provide a cleaning device in which the cleaning housing can be reinforced by the flicker bar.

To achieve the above object, there is provided a cleaning device for the Xerography machine in which a brush 4 in contact with a photoreceptor 1 and an auger for transporting toner scraped off with the brush 4 in the axial direction, are provided within a cleaning housing 6. In the cleaning device, the brush 4 and the auger 5 are disposed separately. A flicker bar 7 to be in contact with the brush 4, is a bar-like member. The flicker bar 7 is fastened at both ends thereof to the cleaning housing 6. In a region where the auger 5 faces the brush 4, distance between the flicker bar 7 and the cleaning housing 6 is also smaller than the diameter of the auger 5.

In the drive part of the cleaning housing, the earth plate is sandwiched by the reinforcing plate and the cleaning housing. The earth plate per se is a single plate for earthing the brush and the flicker bar.

The earthing face of the rotating brush is burred. With this burred face, a reliable contact of it with the end of the shaft of the brush is maintained. A slight shift of this contact location from the center thereof provides a stable earthing. A cutout is formed extended from the boundary of the bent portion of the earth plate. With provision of the cutout, the earthing face has a resiliency, and provides an easy positioning of the burred end part after it is assembled. Phosphorus bronze is used for the earth plate so as to less cut the end of the shaft of the brush (excessive cut will generate harsh sound). The drive gear of the brush is a lotus gear. The drive gear disposed in such a twist direction as to apply a thrust force directed toward the opposite side of the earth plate. Even in a state that the shaft of the brush comes in contact with the member for checking the thrust in the non-drive part, the shaft of the brush is protruded from the end face of the gear.

The brush 4 is flicked with the flicker bar 7. The flicker bar 7 reinforces the cleaning housing 6. Deformation of the auger 5 toward the brush 4 is stopped by the flicker bar 7, thereby preventing the auger 5 from contacting with the brush 4.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention.

DETAILED DESCRIPTION OF THE PREFERRED EMBODIMENTS

The preferred embodiments of a cleaning device according to the present invention will be described with reference to the accompanying drawings.

Figure 1:
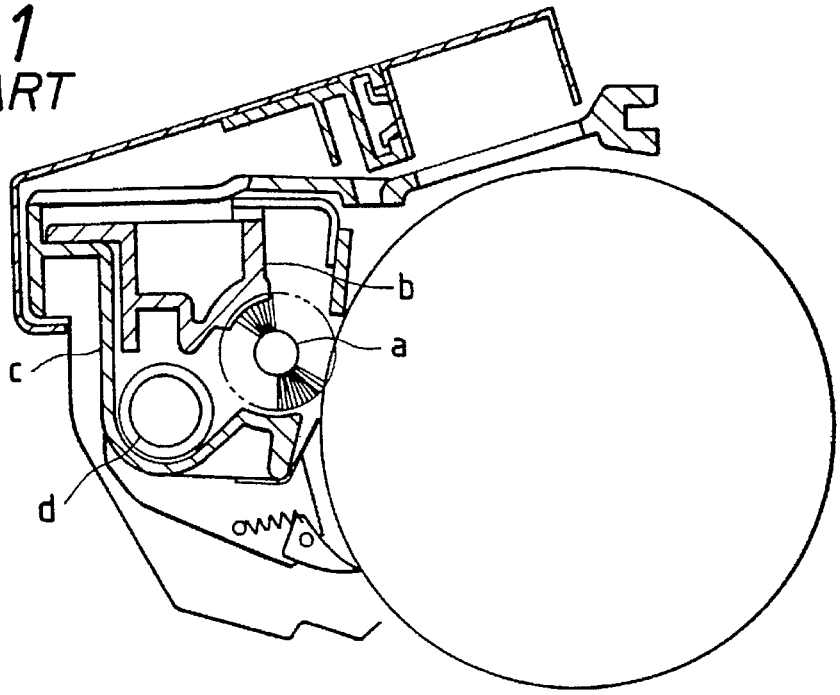
FIG. 1 PRIOR ART
FIG. 1 is a sectional view showing a conventional cleaning device.
Figure 2:
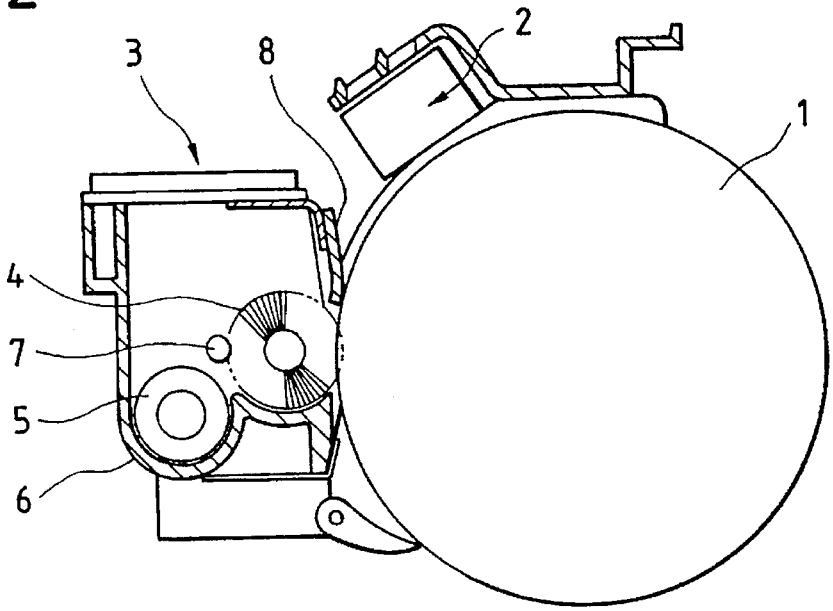
FIG. 2 is a sectional view showing a cleaning device according to a first embodiment of the present invention.

Referring to FIG. 2, there is shown a cleaning device according to a first embodiment of the present invention. In the figure, reference numeral 1 designates a photoreceptor shaped like a drum; 2, a charger; and 3, a cleaning device. The charger 2 and the cleaning device 3 is assembled into a photoreceptor section, with a photoreceptor holder member intervening therebetween. The cleaning device 3 is comprised of a brush 4 which rotatably contacts the photoreceptor 1, an auger 5 located behind the brush 4, a cleaning housing 6 which accommodates these components, a flicker bar 7 located above the auger 5 and between the brush 4 and the auger 5 so as to interfere with the brush 4, a cleaning blade 8 located downstream of the brush 4 so as to rotatably come into contact with the photoreceptor 1. The flicker bar 7 is fastened at both ends thereof to the cleaning housing 6 in a manner that it is forcibly pushed into the cleaning housing 6 or by means of suitable fixing means, such as bolts or nuts.

Figure 3:
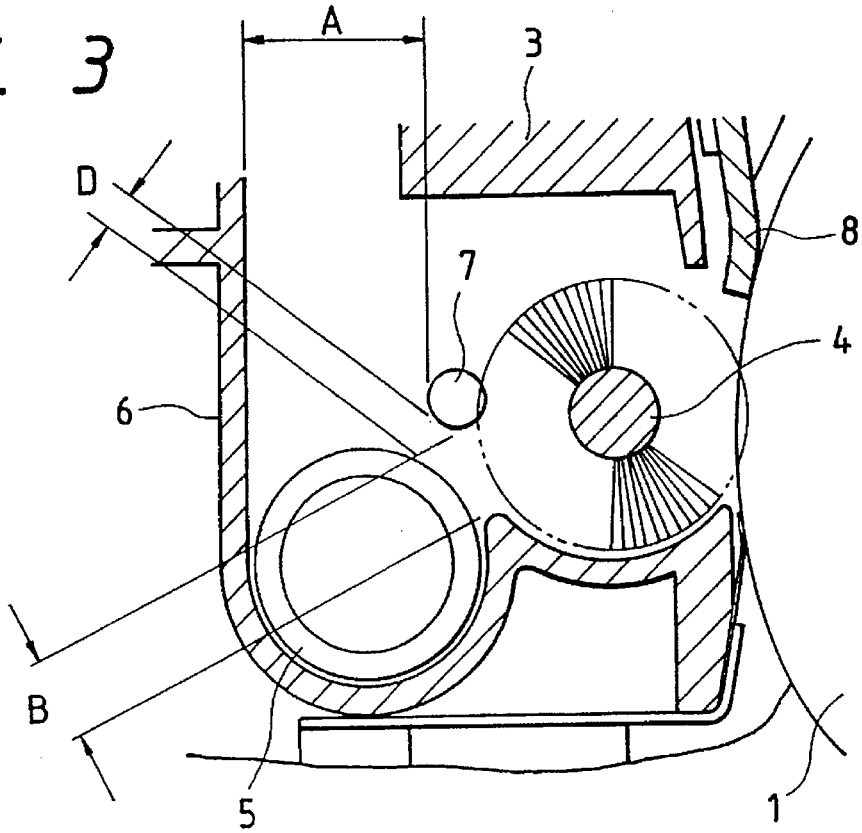
FIG. 3 is an enlarged sectional view showing the cleaning device of FIG. 2.
Figure 4:
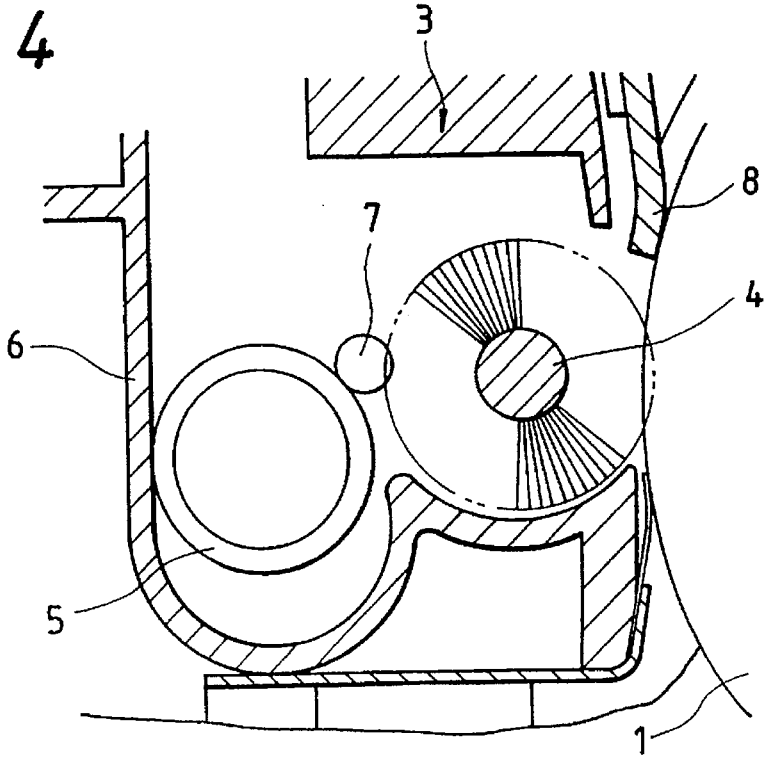
FIG. 4 is an enlarged sectional view showing the cleaning device when an auger is deformed upward.
Figure 5:
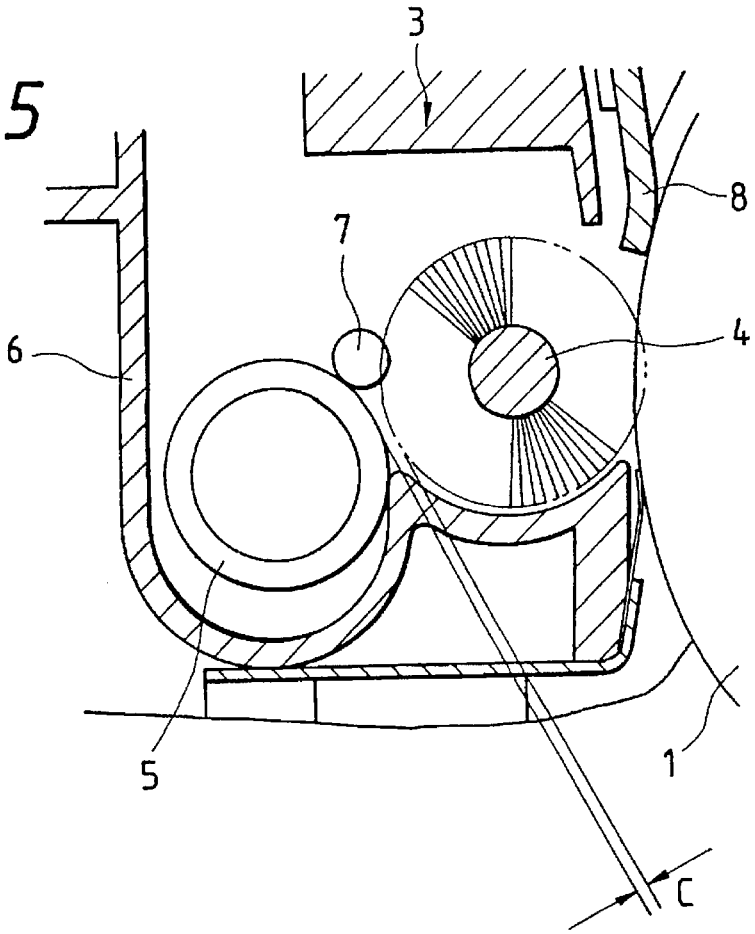
FIG. 5 is an enlarged sectional view showing the cleaning device when the auger is deformed toward the brush.

In FIG. 3 showing an enlarged sectional view of the cleaning device, the nip quantity between the flicker bar 7 and the brush 4 is 0.3 to 1.5 mm. Distance A between the flicker bar 7 and the cleaning housing 6 above the auger 5 is smaller than the diameter of the auger 5. When the auger 5 is deformed upward, it comes in contact with the flicker bar 7 and the cleaning housing 6, so that no further upward movement of it is allowed (FIG. 4). In a region where the auger 5 faces the brush 4, distance B between the flicker bar 7 and the cleaning housing 6 is also smaller than the diameter of the auger 5. When the auger 5 is deformed toward the brush 4, it comes in contact with the flicker bar 7 and the cleaning housing 6, so that no further movement of it toward the brush 4 is allowed (FIG. 5). Accordingly, the auger 5 will never contact the brush 4. When the auger 5 abuts on the flicker bar 7 and the cleaning housing 6, a gap C is present between the auger 5 and the brush 4. Distance D (0.5 to 2 mm) is provided between the auger 5 and the flicker bar 7 so as to prevent the rotating auger 5 from contacting with the flicker bar 7.

Figure 6:
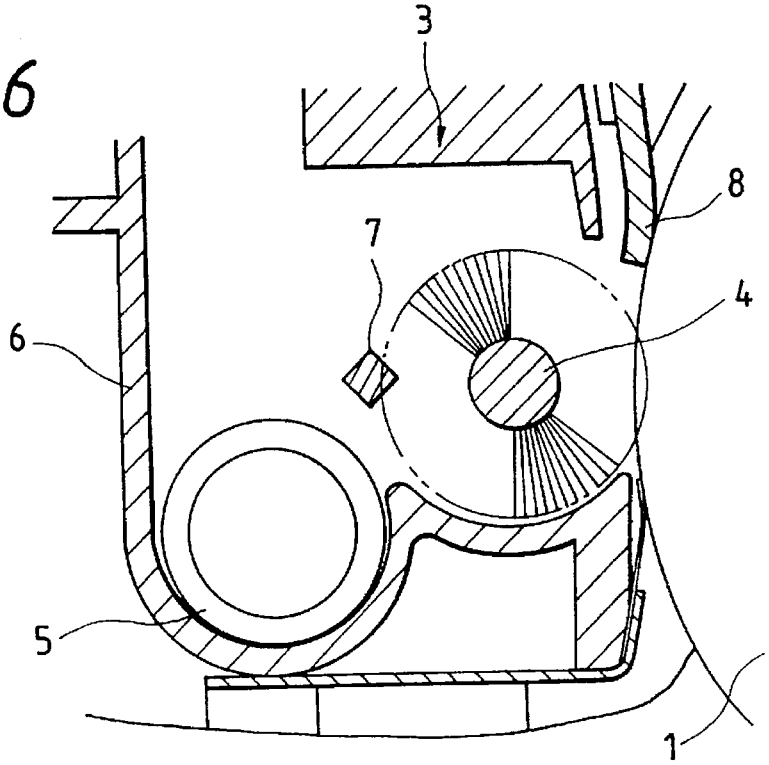
FIG. 6 is an enlarged sectional view showing a modification of the cleaning device of FIG. 2.

While in the above-mentioned embodiment, the shape of the cross section of the flicker bar 7 is circular, it may be square as shown in FIG. 6.

In the embodiment, the flicker bar 7 is made of rigid material so as to prevent transformation of the cleaning housing 6. The rigid material is preferably a reinforced plastic, or a metal. As a reinforced plastic, ABS resin, polycarbonate, or tellurinic acid are preferably used. As a metal, stainless, iron, copper, brass, or aluminum are preferably used. The flicker bar 7 is most preferably made of a metal for earthing. The both ends of the flicker bar 7 are fixed to the cleaning housing 6 so as to prevent transformation of the cleaning housing 6.

In the cleaning device thus constructed, during the cleaning operation, the brush 4 is flicked with the flicker bar 7. Toner scraped off with the brush 4 is transported to one side of the flicker bar 7 by the auger 5. At this time, the auger 5 is rotated not contacting with the flicker bar 7, in a normal state. When the auger 5 is deformed upward or toward the brush 4 by transport resistance, the flicker bar 7 holds back an excessive upward movement of the auger 5 or an excessive approach of the auger 5 to the brush 4.

The cleaning housing 6 is reinforced by the flicker bar 7.

Figure 7:
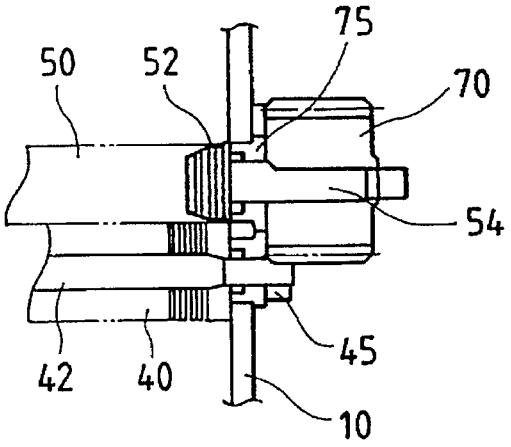
FIG. 7 is a top view showing an auger drive gear.

FIG. 7 is a top view showing an auger drive gear.

Art auger 50, like a coiled spring, is firmly coupled at one end with a drive head 52. The drive head 52 is coupled with a shaft 54 into one piece construction. The shaft 54 is supported by a housing 10, with a bearing 75 inserted therebetween. An auger drive gear 70 is mounted on the shaft 54. The auger drive gear 70 is in mesh with a drive gear 45.

An earth plate 80 is fastened to the housing 10 by screw means. The earth plate 80 is brought into contact with the end of a shaft 42 of a cleaning brush and the end of a flicker bar 60, thereby to remove static electricity generated therein.

Figure 8:
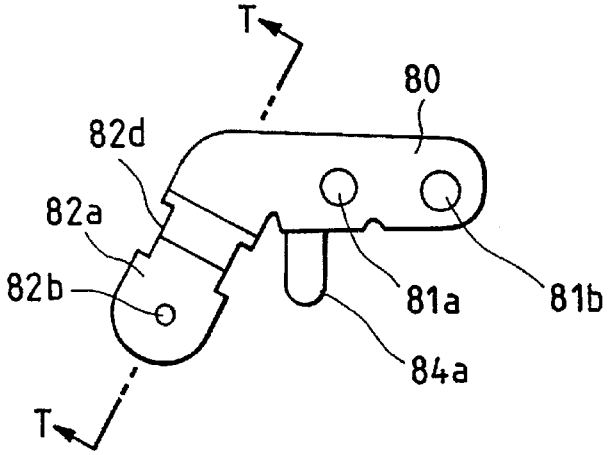
FIG. 8 is a front view showing an earth plate.
Figure 9:
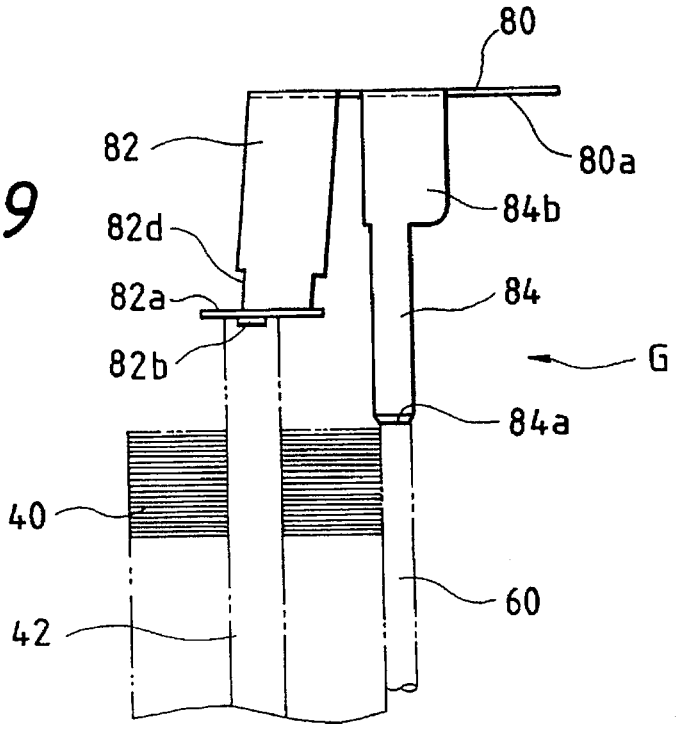
FIG. 9 is a bottom view showing the earth plate.
Figure 10:
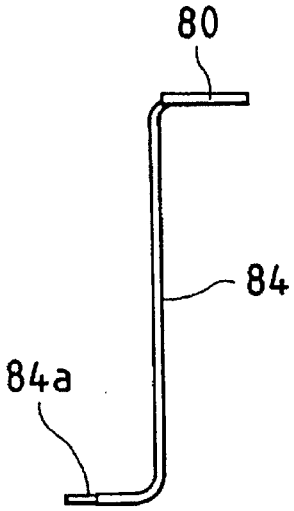
FIG. 10 is a view showing the earth plate when viewed in the direction of an arrow G in FIG. 9.
Figure 11:
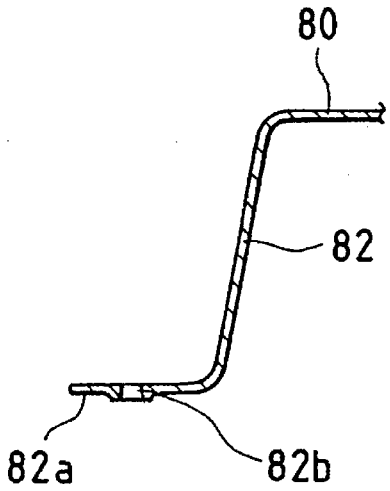
FIG. 11 is a cross sectional view taken on line T—T in FIG. 8.

FIG. 8 is a front view showing the earth plate 80. FIG. 9 is a bottom view showing the earth plate. FIG. 10 is a view showing the earth plate when viewed in the direction of an arrow G in FIG. 9. FIG. 11 is a cross sectional view taken on line T—T in FIG. 8.

The earth plate 80, made of conductive material, is sandwiched by metal plates that are fastened to the housing 10. The earth plate 80 is fastened to these metal plates by using holes 81*a* and 81*b*.

The earth plate 80 is provided with two bent legs 82 and 84. The distal end of the first leg 82 is bent to have an first earth end face 82*a*, which is in contact with the end face of the shaft 42. The central part of the first earth end face 82*a* is burred to have a projection 82*b*. The projection 82*b* enables the first leg 82 to reliably contact with the shaft 42, whereby the shaft 42 is earthed. A cutout 82*d* is formed in the mid portion of the first leg 82. The first earth end face 82*a* generates a spring force to urge the shaft 42.

This construction prevents the shaft 42 from being slipped off and provides a reliable earthing. The shaft 42 rotates together with the cleaning brush 40. During the rotation, the contact of the projection 82*b* with the central part of the shaft 42 is maintained. Therefore, the earthing state is ensured during the rotation of the shaft.

The distal end of the second leg 84 is also bent to have a second earth end face 84*a*. The second earth end face 84*a* is brought into contact with the end face of the flicker bar 60, thereby earthing the flicker bar 60.

Figure 12:
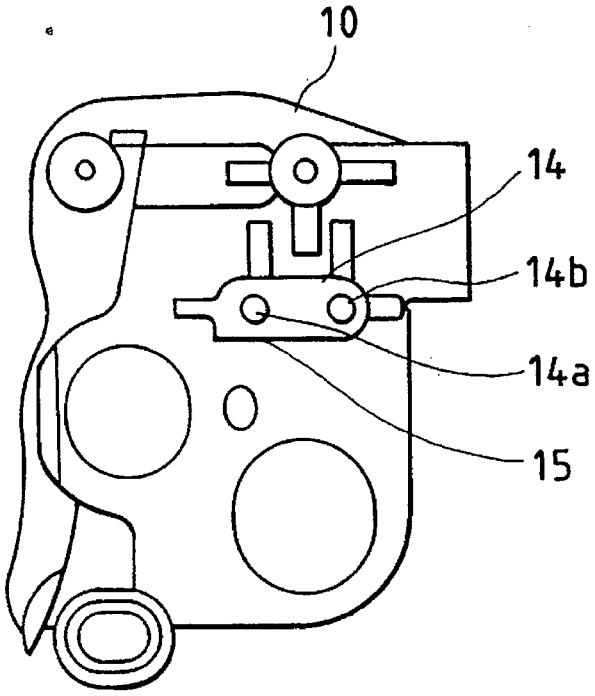
FIG. 12 is a front view showing an earth plate mounting portion of a housing.
Figure 13:
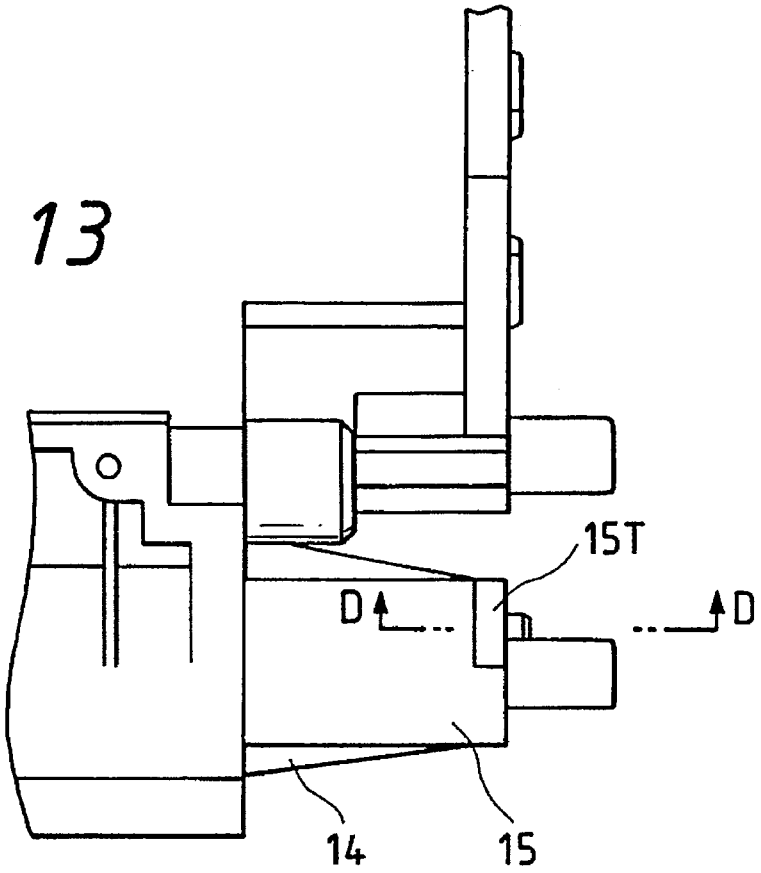
FIG. 13 is a bottom view showing the earth plate mounting portion.
Figure 14:
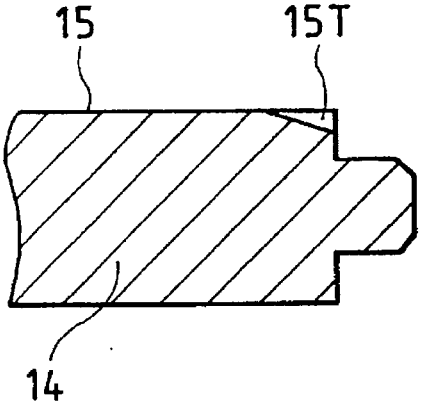
FIG. 14 is a cross sectional view taken on line D—D in FIG. 13.

FIG. 12 is a front view showing an earth plate mounting boss means 14 of the earth plate of the housing 10. FIG. 13 is a bottom view showing the earth plate mounting portion. FIG. 14 is a cross sectional view taken on line D—D in FIG. 13.

The earth plate mounting boss means 14 is formed on the side wall of the housing 10. The earth plate mounting boss means 14 includes a positioning boss 14*a* and a mounting hole 14*b*, which are provided in association with the holes 81*a* and 81*b* of the earth plate 80. The face 80*a* of the earth plate 80 is brought into contact with the face 15 of the earth plate mounting boss means 14. Therefore, in assembling the earth plate 80 into the structure, the earth plate 80 is inserted into the earth plate mounting boss means 14 from the front of the earth plate mounting boss means. During the insertion process, it frequently interferes with other parts or members. To avoid this, a tapered face 15T is formed in the entrance part of the face 15 of the earth plate mounting boss means 14. With provision of the tapered face 15T, the earth plate 80 is smoothly received.

With this structure, the assembling work of the earth plate is simplified, reducing the number of assembling steps.

As described above, in the cleaning device according to the first embodiment of the present invention, the auger 5 is not deformed toward the cleaning housing 6 by the brush 4. The problems of the conventional cleaning device that the auger 5 comes in contact with the cleaning housing 6, generating a harsh sound, and that the inner surface of the cleaning housing 6 is scraped off, are successfully solved.

Further, if the auger 5 is deformed toward the brush 4, it never contacts with the brush 4. Therefore, the brush 4 is not damaged by the auger 5.

Furthermore, the flicker bar 7 serves as one of the strengthening members of the cleaning housing 6, thereby reinforcing the cleaning housing 6.

With the construction as set forth in claims 8 to 10, the number of parts is reduced. The sharp end face is constantly pressed against the shaft of the brush even under an uneven contact. Since the earthing face of the brush has a resiliency, the protrusion (burred part) for earthing reliably seizes the shaft even if a force applied for contact varies.

With the construction as set forth in claim 11, the shaft of the brush is always protruded beyond the end of the drive gear, thereby generating a force to constantly urge the drive gear apart from the earthing face of the earth plate. A stable earthing is ensured.

With the construction as set forth in claim 12, toner leakage can be prevented not using the oil seal that is used by the conventional art. This leads to reduction of cost. As for the recent recycle problems, for disposal of the cleaning device, the device is disassembled and resultant parts are sorted. In the conventional cleaning device, sealing oil must be removed during the disassembling process. In the cleaning device of the present invention, there is no need of the removal of the sealing oil, however.

With the construction as set form in claim 13, the movement of the shaft in the axial direction can be controlled not using the E ring. The performance of the resultant structure, which is comparable with that of the conventional one, can be achieved using a decreased number of parts. As a result, the assembling work is simplified and the cost to assemble is reduced.

What is claimed is:

1. A cleaning device for removing and collecting toner left on the surface of a photoreceptor, comprising:

a housing;

brush means including a rotary shaft rotatably supported by the housing and a brush, provided on the outer surface of the rotary shaft, for scraping off toner from the surface of the photoreceptor;

a bar-like member that is made of reinforced plastic and fastened at both ends thereof to the housing and positioned at a location where the bar-like member is flicked with the brush with rotation of the brush means;

toner transporting means, positioned at a predetermined location within the housing, for transporting the toner scraped off to a given direction; and the bar-like member being disposed so as to prevent the toner transporting means from being further moved from the predetermined position and from contacting with the brush means.

2. The cleaning device according to claim 1, wherein said reinforced plastic is selected from a group of ABS resin, polycarbonate, and tellurinic acid.

3. A cleaning device for removing and collecting toner left on the surface of a photoreceptor, comprising:

a housing;

brush means including a rotary shaft rotatably supported by the housing and a brush, provided on the outer surface of the rotary shaft, for scraping off toner from the surface of the photoreceptor;

a bar-like member fastened at both ends thereof to the housing and positioned at a location where the bar-like member is flicked with the brush with rotation of the brush means;

toner transporting means, positioned at a predetermined location within the housing, for transporting the toner scraped off to a given direction; and the bar-like member being disposed so as to prevent the toner transporting means from being further moved from the predetermined position and from contacting with the brush means, wherein the gap between the bar-like member and the toner transporting means is in a range of 0.5 and 2 mm.

4. A cleaning device for removing and collecting toner left on the surface of photoreceptor, comprising:

a housing;

brush means including a rotary shaft rotatably supported by the housing and a brush, provided on the outer surface of the rotary shaft, for scraping off toner from the surface of the photoreceptor;

a bar-like member fastened at both ends thereof to the housing and positioned at a location where the bar-like member is flicked with the brush with rotation of the brush means;

toner transporting means, positioned at a predetermined location within the housing, for transporting the toner scraped off to a given direction; and the bar-like member being disposed so as to prevent the toner transporting means from being further moved from the predetermined position and from contacting with the brush means;

wherein the housing includes a holding member for holding the bar-like member at a portion except both ends of the bar-like member.

5. The cleaning device according to claim 4, wherein said holding member is integral with said housing.

6. The cleaning device according to claim 4, wherein said housing includes a partially removable member, and said holding member is provided on the partially removably member.

7. A cleaning device for removing and collecting toner left on the surface of a photoreceptor, comprising:

a housing;

brush means including a rotary shaft rotatably supported by the housing and a brush, provided on the outer surface of the rotary shaft, for scraping off toner from the surface of the photoreceptor;

a bar-like member fastened at both ends thereof to the housing and positioned at a location where the bar-like member is flicked with the brush with rotation of the brush means;

toner transporting means, positioned at a predetermined location within the housing, for transporting the toner scraped off to a given direction;

an earthing member brought into contact with the rotary shaft and the bar-like member, thereby earthing both the members; and the bar-like member being disposed so as to prevent the toner transporting means from being further moved from the predetermined position and from contacting with the brush means.

8. An image forming apparatus comprising a housing, a photoreceptor drum supported by the housing, a cleaning brush rotating in contact with the photoreceptor drum, a flicker bar contact with the cleaning brush, and an auger for collecting toner, wherein an earth plate fastened to the side wall of said housing is provided with first and second plate-like terminals, said first terminal is in contact with the end of a shaft of said cleaning brush, and the second terminal is in contact with the end of said flicker bar.

9. The image forming apparatus according to claim 8, wherein the contact face of said first terminal is burred to have a projection.

10. The image forming apparatus according to claim 8, wherein said first terminal includes a cutout to generate a spring force.

11. The image forming apparatus according to claim 8, wherein said earth plate is made of phosphorus bronze.

12. An image forming apparatus comprising a housing, a photoreceptor drum supported by the housing, a cleaning brush rotating in contact with the photoreceptor drum, a flicker bar contact with the cleaning brush, and an auger for collecting toner, wherein the shaft of said auger and the shaft of said cleaning brush are coupled with a gear, said gear mounted on the shaft of said cleaning brush is a lotus gear which pushes inward the shaft when said gear receives a torque.

13. An image forming apparatus comprising a housing, a photoreceptor drum supported by the housing, a cleaning brush rotating in contact with the photoreceptor drum, a flicker bar contact with the cleaning brush, and an auger for collecting toner, wherein labyrinth sealing means, overlapping with each other with a gap therebetween, is formed between a bearing for supporting the shaft of said auger and a head.

* * * * *

UNITED STATES PATENT AND TRADEMARK OFFICE

CERTIFICATE OF CORRECTION

PATENT NO. : 5,625,443

DATED : April 29, 1997

INVENTOR(S) : Kouji OHTA et al.

It is certified that error appears in the above-indentified patent and that said Letters Patent is hereby corrected as shown below:

Claim 4, column 6, line 31, before "photoreceptor", insert --a--.

Signed and Sealed this

Twenty-third Day of September, 1997

*Attest:*

Bruce Lehman

BRUCE LEHMAN

*Attesting Officer*

*Commissioner of Patents and Trademarks*